US009779712B2

(12) United States Patent
Ohnishi

(10) Patent No.: US 9,779,712 B2
(45) Date of Patent: Oct. 3, 2017

(54) INSTALLATION STRUCTURE FOR ACOUSTIC TRANSDUCER, MUSICAL INSTRUMENT, AND INSTALLATION METHOD OF ACOUSTIC TRANSDUCER

(71) Applicant: YAMAHA CORPORATION, Hamamatsu-shi (JP)

(72) Inventor: Kenta Ohnishi, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/301,996

(22) PCT Filed: Apr. 9, 2015

(86) PCT No.: PCT/JP2015/061084
§ 371 (c)(1),
(2) Date: Oct. 5, 2016

(87) PCT Pub. No.: WO2015/156349
PCT Pub. Date: Oct. 15, 2015

(65) Prior Publication Data

US 2017/0116973 A1 Apr. 27, 2017

(30) Foreign Application Priority Data

Apr. 9, 2014 (JP) ..... 2014-080508

(51) Int. Cl.
*G10H 3/14* (2006.01)
*G10H 1/32* (2006.01)

(52) U.S. Cl.
CPC ..... *G10H 3/146* (2013.01); *G10H 1/32* (2013.01)

(58) Field of Classification Search
CPC ..... G10H 3/146; G10H 1/32
(Continued)

(56) References Cited

U.S. PATENT DOCUMENTS 6,965,679 B1 11/2005 Lopez Bosio et al.
7,085,391 B1 8/2006 Yamaya
(Continued)

FOREIGN PATENT DOCUMENTS

DE 3831187 A1 3/1990
EP 1227700 A1 7/2002
(Continued)

OTHER PUBLICATIONS

International Preliminary Report of Patentability issued in Intl. Appln. No. PCT/JP2015/061084, mailed Oct. 20, 2016.
(Continued)

*Primary Examiner* — Jeffrey Donels
(74) *Attorney, Agent, or Firm* — Rossi, Kimms & McDowell LLP

(57) ABSTRACT

An installation structure for an acoustic transducer configured to vibrate a vibrated body in a first direction so as to permit the vibrated body to generate sounds, wherein the acoustic transducer includes: a magnetic-path forming portion that forms a magnetic path; and a vibrating portion configured to vibrate in the first direction with respect to the magnetic-path forming portion, and wherein an anchor is provided between the vibrating portion and the vibrated body such that the anchor is undetachably fixed to the vibrated body by bonding and such that the anchor is detachably fixed to the vibrating portion.

14 Claims, 7 Drawing Sheets

(58) Field of Classification Search
USPC ..... 84/725
See application file for complete search history.

(56) References Cited

U.S. PATENT DOCUMENTS

| | | | | |
|---|---|---|---|---|
| 9,373,314 | B2 | 6/2016 | Takahashi et al. | |
| 2006/0115107 | A1 | 6/2006 | Vincent et al. | |
| 2010/0329486 | A1* | 12/2010 | Scheel | H04R 7/045 381/152 |
| 2013/0061733 | A1 | 3/2013 | Ohnishi et al. | |
| 2013/0092007 | A1 | 4/2013 | Ohnishi et al. | |
| 2013/0118333 | A1 | 5/2013 | Ohnishi et al. | |
| 2014/0202318 | A1* | 7/2014 | Ohnishi | G10C 3/06 84/723 |
| 2015/0128790 | A1 | 5/2015 | Ohnishi et al. | |
| 2015/0163571 | A1* | 6/2015 | Satomi | G10H 1/32 381/162 |
| 2015/0206514 | A1* | 7/2015 | Ohnishi | G10C 3/06 84/725 |
| 2015/0356961 | A1* | 12/2015 | Takahashi | G10H 1/32 84/644 |
| 2016/0035331 | A1* | 2/2016 | Murakami | G10C 3/06 84/726 |

FOREIGN PATENT DOCUMENTS

| | | | |
|---|---|---|---|
| EP | 2571016 | A2 | 3/2013 |
| EP | 2793221 | A1 | 10/2014 |
| JP | S59500531 | A | 3/1984 |
| JP | H04500735 | A | 2/1992 |
| JP | H10145892 | A | 5/1998 |
| JP | H11266496 | A | 9/1999 |
| JP | 2000315088 | A | 11/2000 |
| JP | 2008298992 | A | 12/2008 |
| JP | 2010007835 | A | 1/2010 |
| JP | 2011509583 | A | 3/2011 |
| JP | 2012230406 | A | 11/2012 |
| JP | 2013077000 | A | 4/2013 |
| TW | 466468 | B | 12/2001 |
| WO | 8303022 | A1 | 9/1983 |
| WO | 9003025 | A1 | 3/1990 |
| WO | 0054250 | A1 | 9/2000 |

OTHER PUBLICATIONS

Written Opinion issued in International Application No. PCT/JP2013/085055 dated Mar. 4, 2014.
Office Action issued in U.S. Appl. No. 14/762,611 dated Nov. 10, 2015.
Office Action issued in Tawainese Application No. 102147003 dated Mar. 24, 2015. English translation provided.
International Search Report issued in International Application No. PCT/JP2015/061084 dated Jul. 7, 2015. English translation provided.
International Search Report issued in International Application No. PCT/JP2013/085055 dated Mar. 4, 2014. English translation provided.
European Search Report issued in European Application No. 13872580.9. dated Sep. 28, 2016.
Written Opinion issued in International Application No. PCT/JP2015/061084 dated Jul. 7, 2015.
Office Action issued in Chinese Patent Application No. 201380071180.6 dated Jul. 5, 2017. English translation provided.

* cited by examiner

INSTALLATION STRUCTURE FOR ACOUSTIC TRANSDUCER, MUSICAL INSTRUMENT, AND INSTALLATION METHOD OF ACOUSTIC TRANSDUCER

TECHNICAL FIELD

The present invention relates to an installation structure for an acoustic transducer, a musical instrument including the same, and a method of installing the acoustic transducer.

BACKGROUND ART

Various conventional musical instruments such as keyboard musical instruments include an acoustic transducer installed thereon. The acoustic transducer is configured to vibrate a vibrated body such as a soundboard in a predetermined direction so as to permit the vibrated body to generate sounds. Such an acoustic transducer includes a magnetic-path forming portion that forms a magnetic path and a vibrating portion provided so as to protrude from the magnetic-path forming portion. The vibrating portion is configured to vibrate in a protrusion direction in which the vibrating portion protrudes from the magnetic-path forming portion.

The following Patent Literatures 1 and 2 disclose an installation structure for an acoustic transducer in which the magnetic-path forming portion is fixed to a back post or the like and a distal end portion of the vibrating portion in the protrusion direction is fixed to the vibrated body by bonding, for instance. In this arrangement, when the vibrating portion is vibrated with respect to the magnetic-path forming portion, the vibrated body vibrates in the predetermined direction, whereby sounds are generated by vibration of the vibrated body.

CITATION LIST

Patent Literature

Patent Literature 1: Japanese Unexamined Patent Application Publication No. 2013-077000

Patent Literature 2: Japanese Unexamined Patent Application Publication (Translation of PCT Application) No. 04-500735

SUMMARY

Technical Problem

To suitably obtain sounds generated by vibrating the vibrated body by the acoustic transducer, it is preferable to increase a degree of adhesion between the vibrating portion and the vibrated body. For increasing the degree of adhesion between the vibrating portion and the vibrated body, it is preferable that the vibrating portion be fixed to the vibrated body by bonding, and it is preferable to press the vibrating portion to the vibrated body when bonded to the vibrated body.

The vibrating portion of the acoustic transducer is attached to the magnetic-path forming portion, and the acoustic transducer, especially, the magnetic-path forming portion, is heavy. Thus, it is difficult to press the vibrating portion to the vibrated body with high stability when the vibrating portion is fixed to the vibrated body by bonding. As a result, in the installation structure for the conventional acoustic transducer, the degree of adhesion between the vibrating portion and the vibrated body is undesirably low, and there is a risk that vibration of the vibrating portion does not accurately transmitted to the vibrated body. In this instance, sounds generated by vibration of the vibrated body may undesirably contain noise.

In the installation structure for the conventional acoustic transducer, the vibrating portion is undetachably fixed to the vibrated body, and it is difficult to detach the acoustic transducer from the vibrated body.

The present invention has been developed in view of the situations described above. It is an object of the invention to provide an installation structure for an acoustic transducer which provides suitable sounds generated by vibrating the vibrated body by the acoustic transducer and in which the acoustic transducer is easily detachable from the vibrated body. It is also an object of the invention to provide a musical instrument including the installation structure for the acoustic transducer and a method of installing the acoustic transducer.

Solution to Problem

The object indicated above may be attained according to one aspect of the invention to provide an installation structure for an acoustic transducer configured to vibrate a vibrated body in a first direction so as to permit the vibrated body to generate sounds, wherein the acoustic transducer includes: a magnetic-path forming portion that forms a magnetic path; and a vibrating portion configured to vibrate in the first direction with respect to the magnetic-path forming portion, and wherein an anchor is provided between the vibrating portion and the vibrated body such that the anchor is undetachably fixed to the vibrated body by bonding and such that the anchor is detachably fixed to the vibrating portion.

According to the installation structure for the acoustic transducer constructed as described above, the anchor is detachable from the acoustic transducer (the vibrating portion), and only the anchor can be fixed to the vibrated body. Further, the anchor can be easily formed to have a smaller size and a smaller weight, as compared with the acoustic transducer, whereby the anchor can be pressed onto the vibrated body with high stability when bonded and fixed to the vibrated body. It is thus possible to fix the anchor to the vibrated body while ensuring a high degree of adhesion therebetween.

According to the installation structure for the acoustic transducer constructed as described above, the vibrating portion of the acoustic transducer is detachably fixed to the anchor, whereby the acoustic transducer can be easily detached from the vibrated body.

In the installation structure for the acoustic transducer constructed as described above, a positioning protrusion may be formed at one of the vibrating portion and the anchor so as to protrude toward the other of the vibrating portion and the anchor, and a positioning recess may be formed in the other of the vibrating portion and the anchor such that the positioning protrusion is insertable in the positioning recess in the first direction.

According to the installation structure for the acoustic transducer constructed as described above, when the vibrating portion is attached to the anchor fixed to the vibrated body, the vibrating portion is easily positioned relative to the anchor by inserting the positioning protrusion into the positioning hole. That is, the vibrating portion can be easily attached to the anchor.

In the installation structure for the acoustic transducer constructed as described above, a facing surface of the anchor that faces the vibrated body may include a bonding region bonded to the vibrated body by an adhesive and a non-bonding region not bonded to the vibrated body, and a wetting preventive structure may be formed on the facing surface to prevent the adhesive that leaks from the bonding region from spreading over the non-bonding region.

According to the installation structure for the acoustic transducer constructed as described above, even if the adhesive between the anchor and the vibrated body leaks from the bonding region toward the non-bonding region when the anchor is pressed onto the vibrated body anchor for bonding and fixing the anchor to the vibrated body, the wetting (leakage) preventive structure prevents the adhesive from entering an opening that is open in the non-bonding region. In an instance where the opening is a screw hole used for fastening and fixing the vibrating portion to the anchor, it is possible to prevent the adhesive from interfering with the fixation of the vibrating portion to the anchor.

In the installation structure for the acoustic transducer constructed as described above, the anchor may be provided with a through-hole that penetrates therethrough in the first direction in a state in which the anchor is attached to the vibrated body, and, in the state in which the anchor is attached to the vibrated body, a space may be defined by the vibrated body and the anchor, and at least part of the space may be located between the bonding region of the anchor and the through-hole, so that the wetting preventive structure prevents the adhesive from spreading over the non-bonding region.

In the installation structure for the acoustic transducer constructed as described above, the space may be partially defined by a step formed on the facing surface of the anchor that faces the vibrated body.

In the installation structure for the acoustic transducer constructed as described above, the through-hole may function as the positioning recess.

In the installation structure for the acoustic transducer constructed as described above, the through-hole may be a screw through-hole through which a screw passes for attaching the anchor to the vibrated body.

In the installation structure for the acoustic transducer constructed as described above, the through-hole may be a threaded hole into which a screw is screwed for detachably fixing the vibrating portion to the anchor.

The object indicated above may also be attained according to another aspect of the invention, which provides an installation structure for an acoustic transducer configured to vibrate a vibrated body in a first direction so as to permit the vibrated body to generate sounds, wherein the acoustic transducer includes: a magnetic-path forming portion that forms a magnetic path; a vibrating portion configured to vibrate in the first direction with respect to the magnetic-path forming portion; and an anchor having a bonding region on which an adhesive is applied, the anchor being provided between the vibrating portion and the vibrated body such that the anchor is undetachably fixed to the vibrated body by bonding, wherein the anchor is provided with a through-hole that penetrates therethrough in the first direction in a state in which the anchor is attached to the vibrated body, and wherein, in the state in which the anchor is attached to the vibrated body, a space is defined by the vibrated body and the anchor, and at least part of the space is located between the bonding region of the anchor and the through-hole.

The object indicated above may also be attained according to still another aspect of the invention, which provides a musical instrument, comprising: a vibrated body configured to generate sounds by vibration thereof in the first direction; and the installation structure for the acoustic transducer constructed as described above.

The object indicated above may also be attained according to yet another aspect of the invention, which provides a method of installing, on a vibrated body, an acoustic transducer including a magnetic-path forming portion that forms a magnetic path and a vibrating portion configured to vibrate in a first direction with respect to the magnetic-path forming portion, the acoustic transducer being configured to vibrate the vibrated body in the first direction so as to permit the vibrated body to generate sounds, the method comprising: an anchor fixing step of fixing an anchor to the vibrated body; and a vibrating-portion fixing step of detachably fixing the vibrating portion to the anchor such that the anchor, which has been fixed to the vibrated body in the anchor fixing step, is sandwiched between the vibrating portion and the vibrated body.

ADVANTAGEOUS EFFECTS

According to the present invention, the anchor can be fixed to the vibrated body while ensuring a high degree of adhesion therebetween, so that it is possible to suitably transmit vibration of the vibrating portion to the vibrated body. It is thus possible to suitably obtain sounds generated by vibrating the vibrated body by the acoustic transducer.

According to the present invention, the acoustic transducer can be easily detached from the vibrated body.

DESCRIPTION OF THE EMBODIMENTS

Referring to FIGS. 1 to 8, there will be explained one embodiment of the present invention. In the present embodiment, a piano 1 which is one of keyboard musical instruments is illustrated as a musical instrument to which is applied an installation structure for an acoustic transducer according to one embodiment of the present invention. In FIGS. 1 to 8, a right-left direction, a front-rear direction, and an up-down direction as seen from a player of the piano 1 are respectively defined as an X-axis direction, a Y-axis direction, and a Z-axis direction.

Figure 1:
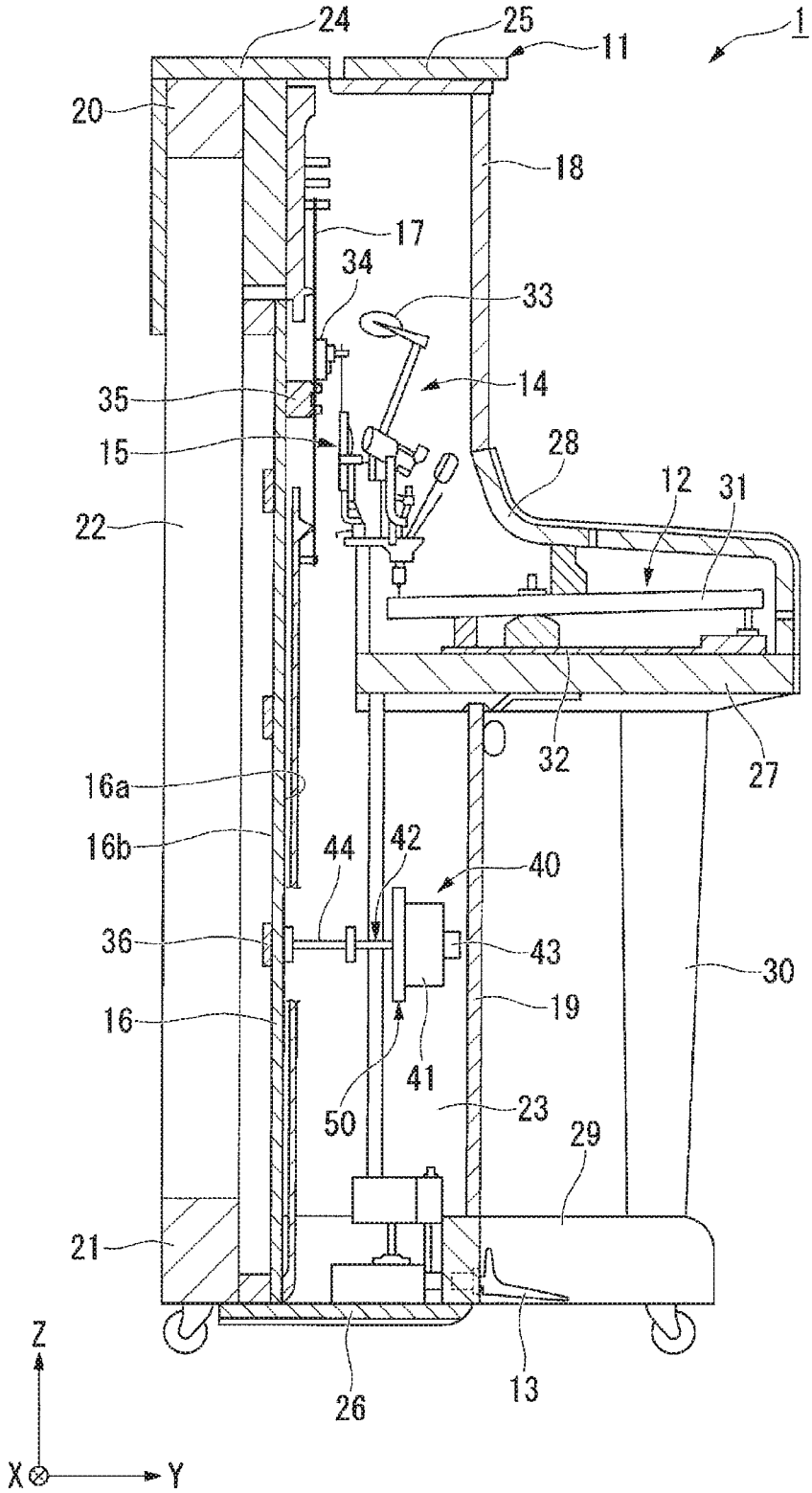
FIG. 1 is a side sectional view of a piano including an installation structure for an acoustic transducer according to one embodiment of the present invention.

As shown in FIG. 1, the piano 1 of the present embodiment is an upright piano which is one sort of an acoustic piano. The piano 1 includes a housing 11, a keyboard portion 12, pedals 13, action mechanisms 14, damper mechanisms 15, a soundboard 16 (as one example of a vibrated body), and strings 17.

The housing 11 includes an upper front panel 18, a lower front panel 19, a rear-side upper beam 20, a rear-side lower beam 21, back posts 22, a pair of side boards 23, a rear roof 24, a front roof 25, a bottom plate 26, a key bed 27, a front rail 28, a pair of toe blocks 29, and a pair of legs 30.

The upper front panel 18 and the lower front panel 19 constitute a front surface of the housing 11 and are spaced apart from each other in the up-down direction (the Z-axis direction).

The rear-side upper beam 20 is disposed on a rear-surface side of the housing 11 so as to be opposed to an upper end portion of the upper front panel 18. The rear-side upper beam 20 extends in the right-left direction (the X-axis direction). The rear-side lower beam 21 is disposed on the rear-surface side of the housing 11 so as to be opposed to a lower end portion of the lower front panel 19. The rear-side lower beam 21 extends in the right-left direction.

The back posts 22 are provided between the rear-side upper beam 20 and the rear-side lower beam 21 so as to extend in the up-down direction. In the side sectional view of the piano 1 shown in FIG. 1, only one back post 22 is seen. A plurality of back posts 22 are arranged so as to be spaced apart from one another in the right-left direction.

The pair of side boards 23 sandwich the upper front panel 18, the lower front panel 19, the rear-side upper beam 20, and the rear-side lower beam 21 in the right-left direction. The side boards 23 are disposed at one and the other end of the piano 1 in the right-left direction. Only one side board 23 is seen in the side sectional view of the piano 1 shown in FIG. 1.

The rear roof 24 and the front roof 25 are disposed so as to contact respective upper ends of the upper front panel 18, the rear-side upper beam 20, and the side boards 23.

The bottom plate 26 is disposed so as to contact respective lower ends of the lower front panel 19, the rear-side lower beam 21, and the side boards 23.

The key bed 27 and the front rail 28 protrude forward (in a positive direction of the Y axis) from an opening defined by a lower end of the upper front panel 18, an upper end of the lower front panel 19, and inner wall surfaces of the side boards 23.

The pair of toe blocks 29 protrude forward respectively from right and left ends of a lower portion of the lower front panel 19. The pair of legs 30 extend between a lower surface of the key bed 27 and the corresponding toe blocks 29.

The keyboard portion 12 has a plurality of keys 31 which are arranged in the right-left direction and which are operated by fingers of the player for performance. Each key 31 is pivotally disposed on the key bed 27 via a key frame 32. A front end portion of each key 31 is exposed to the exterior on a front-surface side of the housing 11 (i.e., the right side in FIG. 1).

The pedals 13 are disposed at the lower end of the lower front panel 19 of the housing 11 and are operated by a foot of the player.

The action mechanism 14 and the damper mechanism 15 are provided for each key 31 and are disposed above a rear end portion of the corresponding key 31.

The action mechanism 14 is a mechanism for converting a force by which the key 31 is depressed by a finger of the player (key depression force) into a force by which the string 17 is struck by a hammer 33 (string striking force or hitting force).

The damper mechanism 15 is a mechanism for converting the key depression force and a force by which a damper pedal (which is one of the pedals 13) is stepped on by a foot of the player (stepping force) into a force by which the dampers 34 on the strings 17 are released therefrom (string release force). The damper mechanisms 15 are disposed together with the action mechanisms 14 in a region in the housing 11 defined by the upper front panel 18, the front rail 28, and the soundboard 16 which will be explained later.

The soundboard 16 is disposed in a region in the housing 11 enclosed by the upper front panel 18, the lower front panel 19, the side boards 23, the rear roof 24, the front roof 25, and the bottom plate 26. Specifically, the soundboard 16 is disposed near to the back posts 22 in the region in the housing 11, such that the soundboard 16 is opposed to the upper front panel 18 and the lower front panel 19 in the front-rear direction (the Y-axis direction).

The strings 17 are provided so as to correspond to the keys 31 and are stretched over an inner surface 16*a* of the soundboard 16 that faces the upper front panel 18 and the lower front panel 19.

There are provided, on the inner surface 16*a* of the soundboard 16, bridges 35 engaging with a part of the strings 17. There are provided soundboard ribs 36 on an outer surface of the soundboard 16 that faces the back posts 22.

In the thus constructed piano 1, when one string 17 is struck by the hammer 33 and is accordingly vibrated, the vibration of the one string 17 is transmitted to the soundboard 16 via the bridges 35 and the soundboard 16 is accordingly vibrated. The vibration of the soundboard 16 propagates through the air, so that sounds are generated. That is, the soundboard 16 generates sounds by being vibrated. The vibration of the soundboard 16 is also transmitted to other strings 17 via the bridges 35, so that other strings 17 are vibrated.

The soundboard 16 is vibrated in the thickness direction thereof (the Y-axis direction). In the following explanation, the direction of the vibration of the soundboard 16 will be referred to as "predetermined direction".

The piano 1 of the present embodiment has an acoustic transducer 40 configured to vibrate the soundboard 16 in the predetermined direction (that coincides with the Y-axis direction and is one example of a first direction), so as to permit the soundboard 16 to generate sounds. Hereinafter, the acoustic transducer 40 will be explained referring to FIGS. 3 and 4.

Figure 3:
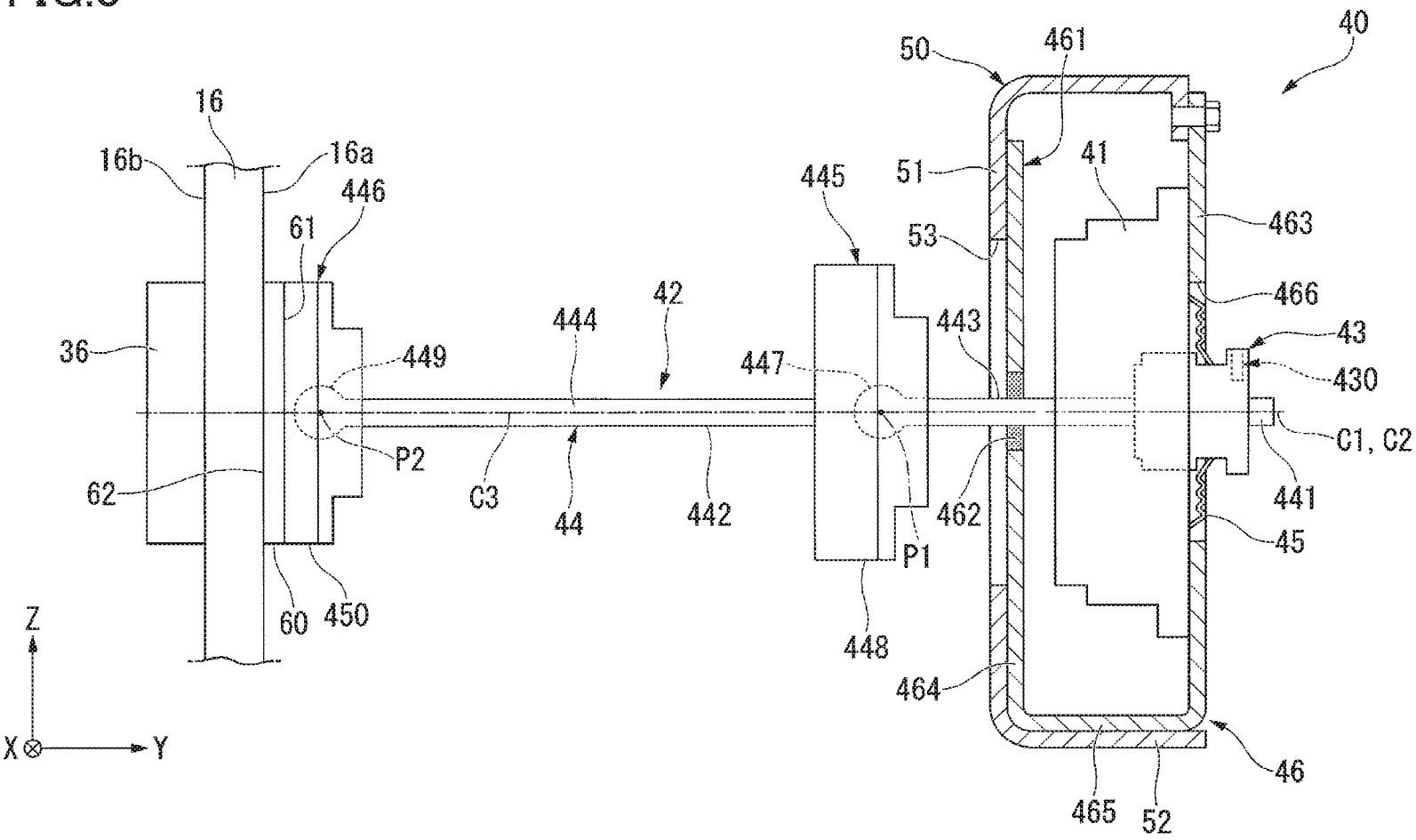
FIG. 3 is a cross-sectional view taken along the line in FIG. 2.
Figure 4:
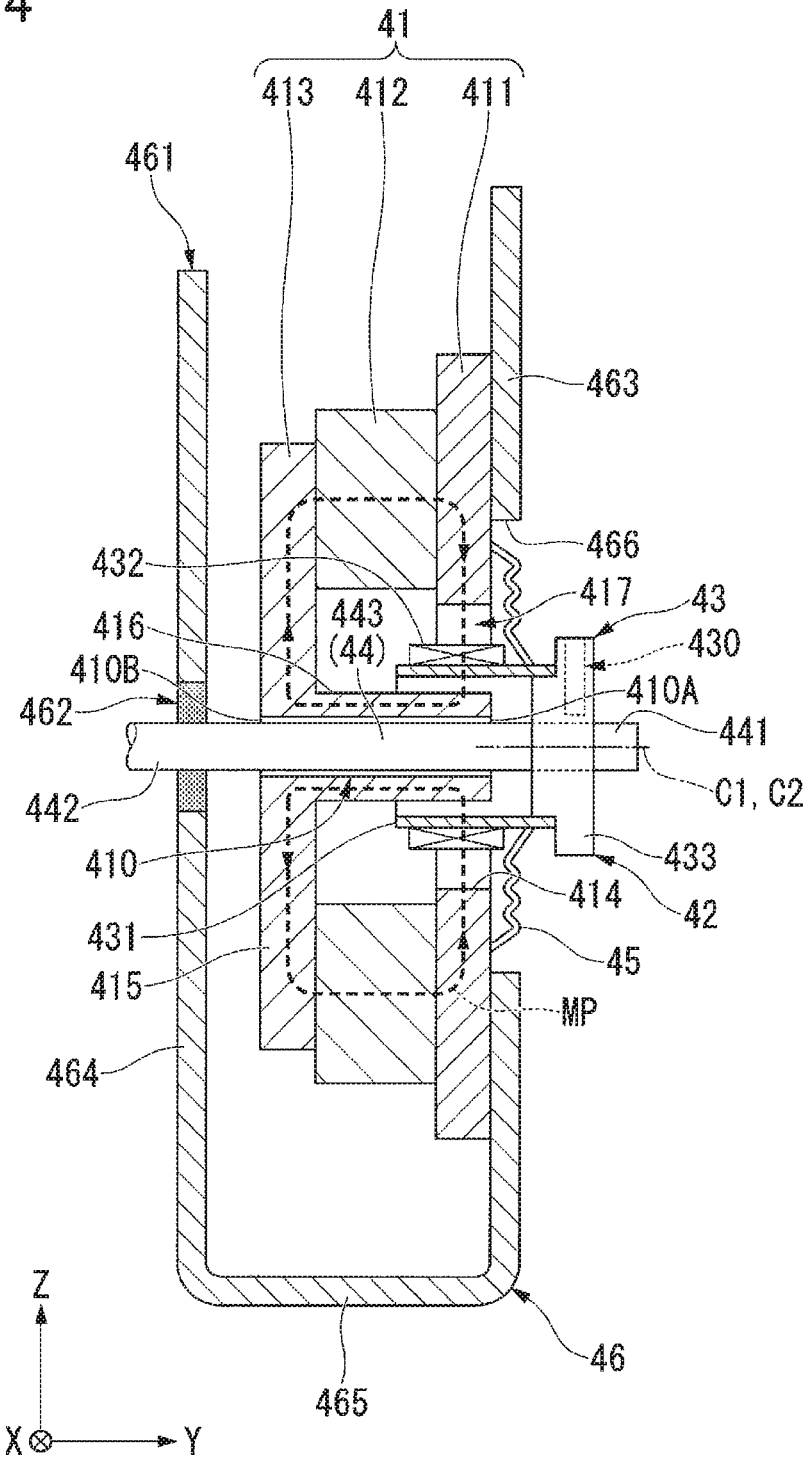
FIG. 4 is an elevational view in vertical cross section of the acoustic transducer shown in FIG. 3.

As shown in FIGS. 3 and 4, the acoustic transducer 40 is an actuator of a voice coil type and includes a magnetic-path forming portion 41 and a vibrating portion 42.

The magnetic-path forming portion 41 forms a magnetic path. An insertion hole 410 is formed through the magnetic-path forming portion 41 in the predetermined direction (the Y-axis direction) for permitting a connecting unit 44 of the vibrating portion 42 to pass through the insertion hole 410.

As shown in FIG. 4, the magnetic-path forming portion 41 of the present embodiment includes a top plate 411, a magnet 412, and a yoke 413.

The top plate 411 is formed of a soft magnetic material such as soft iron. The top plate 411 is shaped like a disc and has a through-hole 414 at its center.

The yoke 413 is formed of a soft magnetic material such as soft iron and is integrally constituted by a disc portion 415 and a cylindrical portion 416 that protrudes from the center of the disc portion 415. The axis of the disc portion 415 and the axis of the cylindrical portion 416 coincide with each other. The cylindrical portion 416 has an outer diameter smaller than an inner diameter of the through-hole 414 of the top plate 411. The above-indicated insertion hole 410 of the magnetic-path forming portion 41 is formed through the disc portion 415 and the cylindrical portion 416 of the yoke 413 in the axis direction thereof.

The magnet 412 is a permanent magnet having an annular shape. The magnet 412 has an inner diameter larger than the inner diameter of the through-hole 414 of the top plate 411.

The magnet 412 is fixed to the disc portion 415 of the yoke 413 in a state in which the cylindrical portion 416 of the yoke 413 passes through the magnet 412. The top plate 411 is fixed to the magnet 412 such that the magnet 412 is sandwiched between the top plate 411 and the disc portion 415 of the yoke 413 and such that a distal end portion of the cylindrical portion 416 is disposed in the through-hole 414 of the top plate 411.

In a state in which the top plate 411, the magnet 412, and the yoke 413 are fixed with one another, the axes thereof coincide with one another and define an axis C1 of the magnetic-path forming portion 41.

In the thus constructed magnetic-path forming portion 41 of the present embodiment, there is formed a magnetic path MP that passes the top plate 411, the cylindrical portion 416, and the disc portion 415 in order from the magnet 412 and returns to the magnet 412. In this arrangement, there is generated, between the inner circumferential surface of the through-hole 414 of the top plate 411 and the outer circumferential surface of the cylindrical portion 416 of the yoke 413, a magnetic field including a component in the diametrical direction of the cylindrical portion 416. That is, a space between the inner circumferential surface of the through-hole 414 of the top plate 411 and the outer circumferential surface of the cylindrical portion 416 of the yoke 413 functions as a magnetic space 417 in which the magnetic field indicated above is generated.

The vibrating portion 42 is provided so as to vibrate with respect to the magnetic-path forming portion 41 in the predetermined direction (the Y-axis direction). The vibrating portion 42 includes a vibrating portion main body 43 and the connecting unit 44.

The vibrating portion main body 43 is disposed on one of opposite sides of the insertion hole 410 that is nearer to a first opening 410A of the insertion hole 410, i.e., on a first-opening (410A) side. The vibrating portion main body 43 is supported by the magnetic-path forming portion 41 through a damper portion 45. The vibrating portion main body 43 is removably fixed to the connecting unit 44 by fixing means 430. The vibrating portion main body 43 of the present embodiment will be explained below in detail.

The vibrating portion main body 43 of the present embodiment includes a bobbin 431, a voice coil 432, and a cap 433.

The bobbin 431 has a cylindrical shape. The bobbin 431, in which the cylindrical portion 416 of the magnetic-path forming portion 41 is inserted, is inserted in the through-hole 414 of the top plate 411. The axis of the bobbin 431 defines an axis C2 of the vibrating portion main body 43.

The voice coil 432 is constituted by conductive wires wound around the outer circumferential surface of the bobbin 431 at one end portion of the bobbin 431 in the axis direction.

The cap 433 is fixed to the bobbin 431 so as to close an opening of the bobbin 431 at the other end portion thereof in the axis direction. The cap 433 is provided with a hole which is formed through the thickness thereof in the axis direction of the bobbin 431 and into which the connecting unit 44 is insertable. The cap 433 is further provided with the above-indicated fixing means 430 for the vibrating portion main body 43. The fixing means 430 is configured to fix, to the cap 433, the connecting unit 44 inserted in the hole of the cap 433. The fixing means 430 is a chuck device, for instance.

The vibrating portion main body 43 is attached to the magnetic-path forming portion 41 by the damper portion 45 such that the one end portion of the bobbin 431 around which the voice coil 432 is wound is located in the magnetic space 417 of the magnetic-path forming portion 41 that is formed on the first-opening (410A) side of the insertion hole 410 and such that the other end portion of the bobbin 431 protrudes from the magnetic-path forming portion 41.

The damper portion 45 has a function of supporting the vibrating portion main body 43 such that the vibrating portion main body 43 does not contact the magnetic-path forming portion 41. The damper portion 45 further has a function of permitting the axis C2 of the vibrating portion main body 43 to coincide with the axis C1 of the magnetic-path forming portion 41 and supporting the vibrating portion main body 43 such that the vibrating portion main body 43 is displaceable with respect to the magnetic-path forming portion 41 in a direction of extension of the axis C1 of the magnetic-path forming portion 41 (i.e., an axis C1 direction).

The damper portion 45 of the present embodiment has an annular shape. The damper portion 45 has a bellows-like shape waved in its diametrical direction. The damper portion 45 is fixed at its inner periphery to the other end portion of the bobbin 431 and at its outer periphery to the top plate 411. The damper portion 45 is formed of a fiber, a resin material, or the like, so as to be elastically deformable.

In the acoustic transducer 40 including the magnetic-path forming portion 41 and the vibrating portion main body 43, when an electric current in accordance with an audio signal passes through the voice coil 432 disposed in the magnetic space 417, the vibrating portion main body 43 vibrates in the axis C1 direction of the magnetic-path forming portion 41. The audio signal is generated in a controller (not shown) as a drive signal for driving the vibrating portion main body 43, on the basis of audio data stored in a memory (not shown), for instance.

As shown in FIGS. 3 and 4, the connecting unit 44 connects the vibrating portion main body 43 and the soundboard 16 to each other, so as to transmit vibration of the vibrating portion main body 43 to the soundboard 16. The connecting unit 44 passes through the insertion hole 410 of the magnetic-path forming portion 41. In the connecting unit 44, a first protruding portion 441 that protrudes from the first opening 410A of the insertion hole 410 is disposed on one-end side of the connecting unit 44 that is located on the first-opening (410A) side of the insertion hole 410. The first protruding portion 441 is removably fixed to the vibrating portion main body 43 by the fixing means 430. In other words, the vibrating portion main body 43 is disposed on the first-opening (410A) side of the magnetic-path forming portion 41 and is fixed to the connecting unit 44 on the first-opening (410A) side. The first-opening (410A) side is defined as a region that is more distant from the soundboard 16 in the predetermined direction than the magnetic-path forming portion 41, as viewed from the soundboard 16, namely, a region that is located on one of the opposite sides of the magnetic-path forming portion 41 remote from the soundboard 16 in the predetermined direction. In the connecting unit 44, a second protruding portion 442 that protrudes from a second opening 410B of the insertion hole 410 is disposed on the other-end side of the connecting unit 44 that is located on a second-opening (410B) side. The second-opening (410B) side is the other of the opposite sides of the insertion hole 410 that is nearer to the second opening 410B of the insertion hole 410 and is defined as a region that is nearer to the soundboard 16 in the predetermined direction than the magnetic-path forming portion 41, as viewed from the soundboard 16, namely, a region that is located on the other of the opposite sides of the magnetic-path forming portion 41 nearer to the soundboard 16 in the predetermined direction. A distal end of the second protruding portion 442 in its protrusion direction, which is the other end of the connecting unit 44, is connected to the soundboard 16. In other words, the soundboard 16 is connected to the connecting unit 44 on the second-opening (410B) side.

The connecting unit 44 of the present embodiment includes a rod-like vibrating-side shaft portion 443 that passes through the insertion hole 410 of the magnetic-path forming portion 41, a rod-like vibrated-side shaft portion 444 that protrudes from the soundboard (16) side toward the magnetic-path forming portion 41, and an intermediate joint portion 445 that connects the vibrating-side shaft portion 443 and the vibrated-side shaft portion 444 to each other.

The vibrating-side shaft portion 443 includes the first protruding portion 441 and a proximal end portion of the second protruding portion 442 in its protrusion direction. One end of the vibrating-side shaft portion 443, which corresponds to the first protruding portion 441, extends through the cap 433 of the vibrating portion main body 43 and is fixed to the cap 433 of the vibrating portion main body 43 by the fixing means 430. Thus, the axis of the vibrating-side shaft portion 443 coincides with the axis C2 of the vibrating portion main body 43.

The vibrated-side shaft portion 444 provides a distal end portion of the second protruding portion 442 in its protrusion direction located on the soundboard (16) side.

The intermediate joint portion 445 allows the axis C2 of the vibrating-side shaft portion 443 and an axis C3 of the vibrated-side shaft portion 444 to incline relative to each other. The intermediate joint portion 445 of the present embodiment has the so-called ball joint structure. The intermediate joint portion 445 includes a spherical portion 447 formed at one end of one of the vibrating-side shaft portion 443 and the vibrated-side shaft portion 444 and a retainer portion 448 formed at one end of the other of the vibrating-side shaft portion 443 and the vibrated-side shaft portion 444. The retainer portion 448 rotatably holds the spherical portion 447. In the illustrated example, the spherical portion 447 is formed at one end of the vibrating-side shaft portion 443 while the retainer portion 448 is formed at one end of the vibrated-side shaft portion 444.

A center P1 of the intermediate joint portion 445 (the spherical portion 447) is located on both of the axis C2 of the vibrating-side shaft portion 443 and the axis C3 of the vibrated-side shaft portion 444. Thus, the axis C2 of the vibrating-side shaft portion 443 and the axis C3 of the vibrated-side shaft portion 444 can incline relative to each other about the center P1 of the intermediate joint portion 445. That is, the connecting unit 44 of the present embodiment is bendable at the intermediate joint portion 445.

The connecting unit 44 further includes a distal joint portion 446 disposed at one end of the vibrated-side shaft portion 444 which corresponds to the distal end of the second protruding portion 442 connected to the soundboard 16. The distal joint portion 446 allows the axis C3 of the vibrated-side shaft portion 444 to incline with respect to the predetermined direction (the Y-axis direction).

The distal joint portion 446 of the present embodiment has a ball joint structure similar to that of the intermediate joint portion 445. The distal joint portion 446 includes a spherical portion 449 formed at one end of the vibrated-side shaft portion 444 and a retainer portion 450 fixed to the soundboard 16 and rotatably holding the spherical portion 449.

A center P2 of the distal joint portion 446 (the spherical portion 449) is located on the axis C3 of the vibrated-side shaft portion 444. Thus, the axis C3 of the vibrated-side shaft portion 444 can incline with respect to the predetermined direction (the Y-axis direction) about the center P2 of the distal joint portion 446.

As shown in FIG. 4, the acoustic transducer 40 of the present embodiment has a restrictor 46 engaging with one end of the vibrating-side shaft portion 443 which corresponds to the proximal end portion of the second protruding portion 442. The restrictor 46 is configured to restrict a movement of the vibrating-side shaft portion 443 in a direction intersecting a direction of extension of the axis C2 while allowing a movement of the vibrating-side shaft portion 443 in the direction of extension of the axis C2 (i.e., the axis C2 direction), at a position at which the restrictor 46 engages with the vibrating-side shaft portion 443.

The restrictor 46 of the present embodiment includes a frame portion 461 and a contact member 462.

The frame portion 461 is formed by bending a plate member formed of metal or the like. The frame portion 461 includes: a fixing plate portion 463 that is superposed on and fixed to one end face of the magnetic-path forming portion 41 located on the first-opening (410A) side of the insertion hole 410; an engaging plate portion 464 that is disposed so as to be opposed to another end face of the magnetic-path forming portion 41 located on the second-opening (410B) side of the insertion hole 410; and a connecting plate portion 465 which extends, on the side portion of the magnetic-path forming portion 41, in the direction of extension of the axis C1 of the magnetic-path forming portion 41 and which connects the fixing plate portion 463 and the engaging plate portion 464 to each other.

The fixing plate portion 463 is fixed to the top plate 411. The fixing plate portion 463 is provided with an opening hole 466 that penetrates therethrough in the thickness direction, for preventing the fixing plate portion 463 from interfering with the vibrating portion main body 43, the first protruding portion 441 of the connecting unit 44, and the damper portion 45 that protrude from the top plate 411. The engaging plate portion 464 is disposed so as to face the disc portion 415 of the yoke 413. The engaging plate portion 464 is provided with a hole that penetrates therethrough in the thickness direction, for permitting the vibrating-side shaft portion 443 to pass through the hole.

The contact member 462 has an annular shape and is formed of a soft fiber member such as felt or cloth. The contact member 462 is fixed by bonding or the like to the inner circumferential surface of the hole of the engaging plate portion 464. The contact member 462 functions as a bushing for filling a clearance between the hole of the engaging plate portion 464 and the vibrating-side shaft portion 443 passing through the hole. That is, the contact member 462 is held in contact with a part of the vibrating-side shaft portion 443 located within the hole of the engaging plate portion 464 and is held in engagement with the vibrating-side shaft portion 443.

The thus constructed restrictor 46 restricts a movement of the vibrating-side shaft portion 443 in a direction perpendicular to the axis C2 direction while allowing a movement of the vibrating-side shaft portion 443 in the axis C2 direction, at the position at which the contact member 462 of the restrictor 46 is held in engagement with the vibrating-side shaft portion 443.

Referring next to FIGS. 1 to 8, the installation structure for installing the acoustic transducer 40 constructed as described above on the piano 1 will be explained.

Figure 2:
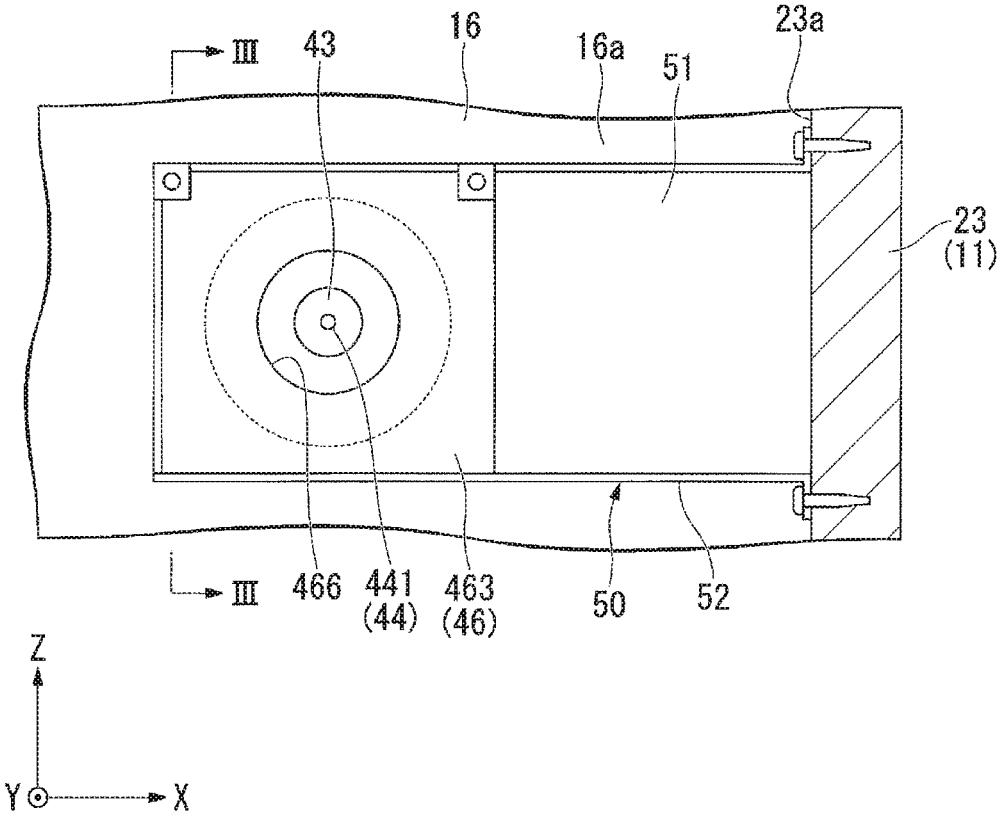
FIG. 2 is a plan view of a structure for fixing a magnetic-path forming portion of the acoustic transducer to the piano shown in FIG. 1, as seen from a player's side of the piano.

As shown in FIGS. 1 to 3, the magnetic-path forming portion 41 of the acoustic transducer 40 is fixed to the housing 11 as a support portion for fixation. The magnetic-path forming portion 41 is fixed to the housing 11 such that the second opening 410B (FIG. 4) of the insertion hole 410 is opposed to the inner surface 16*a* or an outer surface 16*b* of the soundboard 16 as a major surface thereof and such that the axis C2 of the magnetic-path forming portion 41 extends in parallel with the predetermined direction (the Y-axis direction) which is perpendicular to the major surface of the soundboard 16. Further, the magnetic-path forming portion 41 is fixed to the housing 11 such that the vibrating portion main body 43 protrudes from the magnetic-path forming portion 41 in a direction away from the major surface of the soundboard 16.

In the present embodiment, the magnetic-path forming portion 41 is disposed in the housing 11 so as to be opposed to the inner surface 16*a* of the soundboard 16. In the present embodiment, the magnetic-path forming portion 41 is disposed in a region of the housing 11 which is located between the lower front panel 19 and the soundboard 16. Further, the magnetic-path forming portion 41 is fixed to the housing 11 via a support portion 50. The support portion 50 is fixed to the side board 23 of the housing 11 and extends from an inner surface 23*a* of the side board 23 in the X-axis direction.

The support portion 50 in the present embodiment is formed by bending a plate member formed of metal or the like. The support portion 50 includes a positioning plate portion 51 disposed between the soundboard 16 and the magnetic-path forming portion 41 and a support plate portion 52 that supports the magnetic-path forming portion 41 from the lower side of the magnetic-path forming portion 41 in the vertical direction. The positioning plate portion 51 is provided with an opening hole 53 that penetrates therethrough in the thickness direction for permitting the connecting unit 44 of the acoustic transducer 40 to pass through the opening hole 53.

The magnetic-path forming portion 41 is fixed by screwing or the like to the support portion 50 constructed as described above. The magnetic-path forming portion 41 is pressed onto the positioning plate portion 51 and is placed on the support plate portion 52, whereby the magnetic-path forming portion 41 is positioned relative to the housing 11 and the soundboard 16.

In the present embodiment, the engaging plate portion 464 of the frame portion 461 is interposed between the magnetic-path forming portion 41 and the positioning plate portion 51, so that the engaging plate portion 464 is pressed onto the positioning plate portion 51. The connecting plate portion 465 of the frame portion 461 is interposed between the magnetic-path forming portion 41 and the support plate portion 52, so that the connecting plate portion 465 is placed on the support plate portion 52.

The vibrating portion 42 of the acoustic transducer 40 is connected to the inner surface 16*a* of the soundboard 16 as its major surface. The position at which the vibrating portion 42 is connected to the soundboard 16 is preferably determined to be a position at which the soundboard 16 is sandwiched by and between the vibrating portion 42 and the soundboard rib 36 provided on the outer surface 16*b* of the soundboard 16.

In the present embodiment, the retainer portion 450 of the distal joint portion 446, which is provided at one end of the vibrated-side shaft portion 444 that corresponds to the distal end of the second protruding portion 442 of the connecting unit 44, is fixed to the inner surface 16*a* of the soundboard 16. Further, in the present embodiment, an intervening member 60 (as one example of an anchor) is provided between the retainer portion 450 and the soundboard 16, and the retainer portion 450 is fixed to the soundboard 16 via the intervening member 60.

The intervening member 60 is undetachably fixed to the soundboard 16 by bonding and is detachably fixed to the vibrating portion 42. The intervening member 60 is shaped like a plate and is disposed such that the thickness direction of the intervening member 60 coincides with the predetermined direction (which coincides with the Y-axis direction and is one example of the first direction).

As shown in FIGS. 3 and 5 to 7, the intervening member 60 is provided with a positioning recess 63A (as one example of a through-hole) which is recessed from its first facing surface 61 that faces the retainer portion 450 of the distal joint portion 446. In the present embodiment, the positioning recess 63A penetrates the intervening member 60 in the thickness direction thereof (as one example of the first direction). The retainer portion 450 is provided with a positioning protrusion 63B which protrudes toward the intervening member 60 and which is insertable in the positioning recess 63A in the predetermined direction. The positioning protrusion 63B is fitted into the positioning recess 63A with no clearance formed therebetween. Thus, the retainer portion 450 that corresponds to the distal end of the connecting unit 44 is positioned relative to the intervening member 60.

The intervening member 60 is provided with internally threaded holes 65 (each as one example of a screw hole) into which screws 64 are screwed for fixing and fastening the retainer portion 450 (the vibrating portion 42) to the intervening member 60. The screws 64 are screwed into the respective internally threaded holes 65, whereby vibrating portion 42 is detachably fixed to the intervening member 60. Each internally threaded hole 65 is formed through the thickness of the intervening member 60. A plurality of internally threaded holes 65 (three internally threaded holes 65 in the illustrated example) are formed so as to be spaced apart from one another in the circumferential direction of the intervening member 60.

The intervening member 60 is further provided with screw insertion holes 67 (each as one example of a screw through-hole) into which screws 66 are screwed for fixing and fastening the intervening member 60 to the soundboard 16. A plurality of screw insertion holes 67 (three screw insertion holes 67 in the illustrated example) are formed so as to be spaced apart from one another in the circumferential direction of the intervening member 60.

The internally threaded holes 65 and the screw insertion holes 67 are alternately disposed in the circumferential direction of the intervening member 60.

Figure 5:
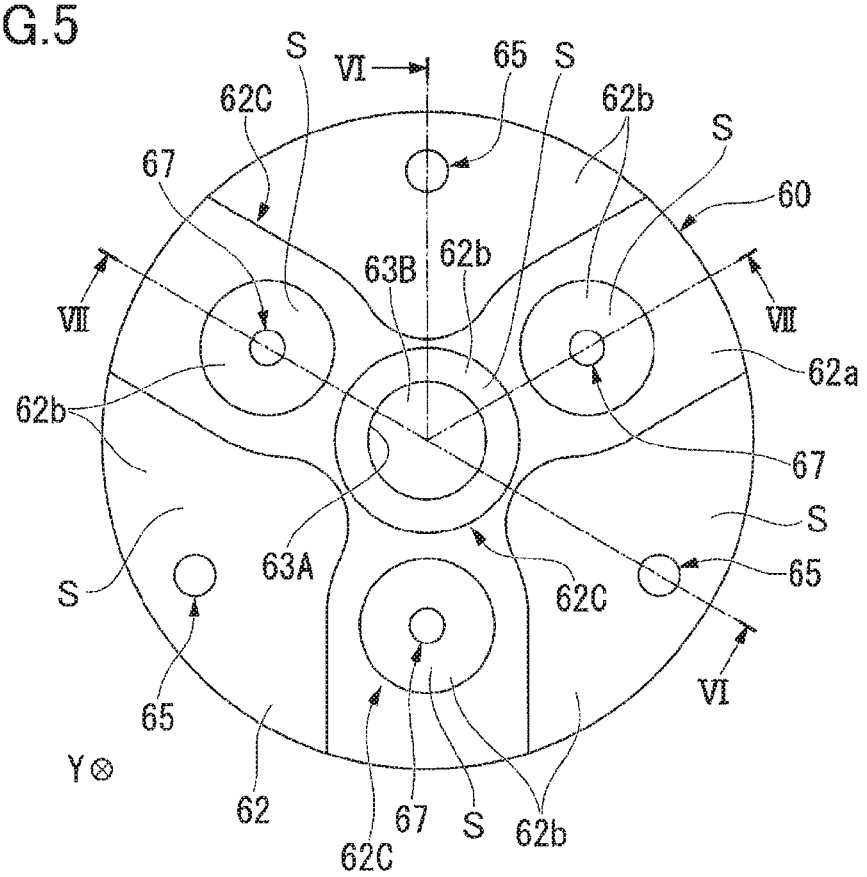
FIG. 5 is a plan view of an intervening member shown in FIG. 3 disposed between a vibrating portion and a soundboard, as seen from the soundboard side.
Figure 6:
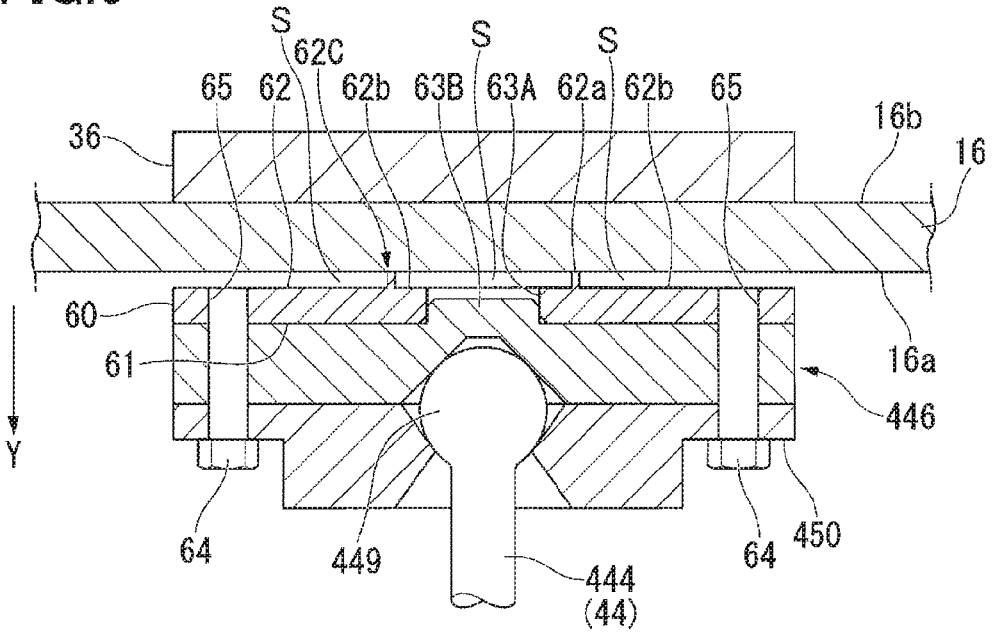
FIG. 6 is a cross-sectional view taken along the line VI-VI in FIG. 5.
Figure 7:
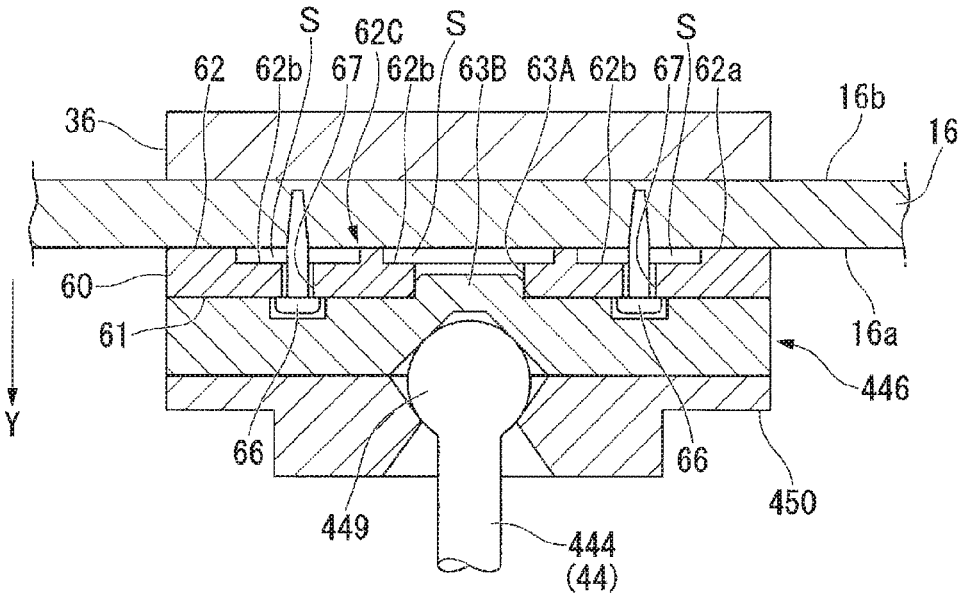
FIG. 7 is a cross-sectional view taken along the line VII-VII in FIG. 5.

A second facing surface 62 (as one example of a facing surface) of the intervening member 60 that faces the soundboard 16 includes a bonding region 62*a* which is bonded to the soundboard 16 by an adhesive (not shown) and a non-bonding region 62*b* which is not bonded to the soundboard 16. A wetting (leakage) preventive structure 62C is formed on the second facing surface 62 for preventing the adhesive that leaks from the bonding region 62*a* from spreading over the non-bonding region 62*b*. The wetting preventive structure 62C of the present embodiment is constituted by: a step which is formed on the second facing surface 62 such that the non-bonding region 62*b* is located at a height level lower than the bonding region 62*a;* and the non-bonding region 62*b* that is spaced apart from the inner surface 16*a*. The step and the non-bonding region 62*b* define a space S. The non-bonding region 62*b* includes regions of the second facing surface 62 in which the positioning recess 63A, the internally threaded holes 65, and the screw insertion holes 67 are open. As shown in FIGS. 5-7, in a state in which the intervening member 60 is attached to the soundboard 16, the space S is defined by the inner surface 16*a* of the soundboard 16, the non-bonding region 62*b*, and the step. Part of the space S is located between the bonding region 62*a* and the positioning recess 63A. The adhesive that leaks from the bonding region 62*a* flows into the part of the space S and is prevented from spreading toward the non-bonding region 62*b*. As a result, the adhesive is prevented from reaching the positioning recess 63A. Thus, the space S formed by the step between the soundboard 16 and the intervening member 60 has a wetting preventive function. Similarly, another part of the space S is located between the bonding region 62*a* and the internally threaded hole 65. Further, still another part of the space S is located between the bonding region 62*a* and the screw insertion hole 67.

There will be next explained a method of installing the acoustic transducer 40 of the present embodiment on the piano 1.

When installing the acoustic transducer 40 on the piano 1, an intervening-member fixing step is first performed for fixing the intervening member 60 to the soundboard 16. In this step, an adhesive is applied to the bonding region 62*a* of the second facing surface 62 of the intervening member 60, and the second facing surface 62 of the intervening member 60 is pressed onto the inner surface 16*a* of the soundboard 16. Thus, the intervening member 60 is undetachably fixed to the soundboard 16.

In the present embodiment, the non-bonding region 62*b* of the second facing surface 62 of the intervening member 60 cooperates with the bonding region 62*a* to sandwich the space S therebetween and is located at a height level lower than the bonding region 62*a*, owing to the wetting preventive structure 62C. Consequently, even if the adhesive overflows the bonding region 62*a* and spreads toward the non-bonding region 62*b* when the intervening member 60 is pressed onto the soundboard 16, the adhesive is prevented from entering the positioning recess 63A, the internally threaded holes 65, and the screw insertion holes 67 which are open in the non-bonding region 62*b*.

In the present embodiment, after the intervening member 60 has been bonded and fixed to the soundboard 16, the screws 66 are inserted into the respective screw insertion holes 67 of the intervening member 60 and are screwed to the soundboard 16, whereby the intervening member 60 is fixed and fastened to the soundboard 16.

Before or after the intervening-member fixing step, a support-portion fixing step is performed for fixing the support portion 50 to the housing 11. In one of the intermediate-member fixing step and the support-portion fixing step which is later performed, the intervening member 60 and the support portion 50 are preferably positioned relative to each other using a jig not shown. In particular, the intervening member 60 and the support portion 50 are preferably positioned relative to each other in the direction (the X-axis direction and the Z-axis direction) perpendicular to the predetermined direction (the Y-axis direction).

Subsequently, a vibrating-portion fixing step is performed for detachably fixing the vibrating portion 42 of the acoustic transducer 40 to the intervening member 60, such that the intervening member 60 is sandwiched by and between the vibrating portion 42 and the soundboard 16.

In the vibrating-portion fixing step in the present embodiment, a connecting-unit fixing step is initially performed for fixing the connecting unit 44 of the vibrating portion 42 to the intervening member 60.

In this step, the retainer portion 450 of the distal joint portion 446 is initially disposed so as to be superposed on the first facing surface 61 of the intervening member 60. In this instance, the positioning protrusion 63B of the retainer portion 45 is fitted into the positioning recess 63A of the intervening member 60, whereby the retainer portion 450 is positioned relative to the intervening member 60. Thereafter, the screws 64 are inserted so as to pass through the retainer portion 450 and are screwed into the internally threaded holes 65 of the intervening member 60. Thus, the retainer portion 450 is fastened and fixed to the intervening member 60. In a state after this step has been performed, the vibrating-side shaft portion 443 of the connecting unit 44 passes through the opening hole 53 of the positioning plate portion 51 of the support portion 50.

In the vibrating-portion fixing step, a main-body fixing step is performed after the connecting-unit fixing step, so as to fix the vibrating portion main body 43 of the vibrating portion 42 to the connecting unit 44.

In the main-body fixing step, the vibrating-side shaft portion 443 of the connecting unit 44 is inserted into the through-hole 414 of the frame portion 461 integrally fixed to the magnetic-path forming portion 41, the insertion hole 410 of the magnetic-path forming portion 41, and the opening of the vibrating portion main body 43 in this order. Subsequently, one end of the vibrating-side shaft portion 443, which corresponds to the first protruding portion 441 of the connecting unit 44, is fixed to the vibrating portion main body 43 by the fixing means 430. In this state, the axis of the vibrating-side shaft portion 443 coincides with the axis C2 of the vibrating portion main body 43.

In a period from the end of the connecting-unit fixing step of the vibrating-portion fixing step to the end of the main-body fixing step of the vibrating-portion fixing step, a magnetic-path-forming-portion fixing step is performed for fixing the magnetic-path forming portion 41 to the support portion 50. The magnetic-path-forming-portion fixing step may be performed in parallel with the main-body fixing step.

In the magnetic-path-forming-portion fixing step, the connecting plate portion 465 of the frame portion 461 integrally fixed to the magnetic-path forming portion 41 is placed on the support plate portion 52 of the support portion 50, and the engaging plate portion 464 of the frame portion 461 is disposed so as to be superposed on the positioning plate portion 51 of the support portion 50. Thus, the magnetic-path forming portion 41 is positioned relative to the housing 11, the soundboard 16, and the connecting unit 44. Thereafter, the frame portion 461 is fixed to the support portion 50 by screwing or the like, whereby the magnetic-path forming portion 41 is fixed to the support portion 50.

In this wary, the acoustic transducer 40 is installed on the piano 1.

In the installation method described above, the intervening member 60 fixed to the soundboard 16 and the support portion 50 fixed to the housing 11 are positioned relative to each other, and the magnetic-path forming portion 41 is positioned relative to the support portion 50, so that the axis C1 of the magnetic-path forming portion 41 is made parallel to the predetermined direction (the Y-axis direction), as shown in FIG. 3. Further, the axis C1 of the magnetic-path forming portion 41, the axis C2 of the vibrating portion main body 43, the axis of the vibrating-side shaft portion 443 of the connecting unit 44, and the axis C3 of the vibrated-side shaft portion 444 coincide with one another.

When a drive signal based on an audio signal is input to the voice coil 432 of the acoustic transducer 40 in the piano 1 on which the acoustic transducer 40 is installed as described above, the vibrating portion main body 43 vibrates in the predetermined direction. The vibration of the vibrating portion main body 43 is transmitted to the soundboard 16 by the connecting unit 44, so that the soundboard 16 vibrates in the predetermined direction. The vibration of the soundboard 16 propagates in the air, so that sounds are generated.

Figure 8:
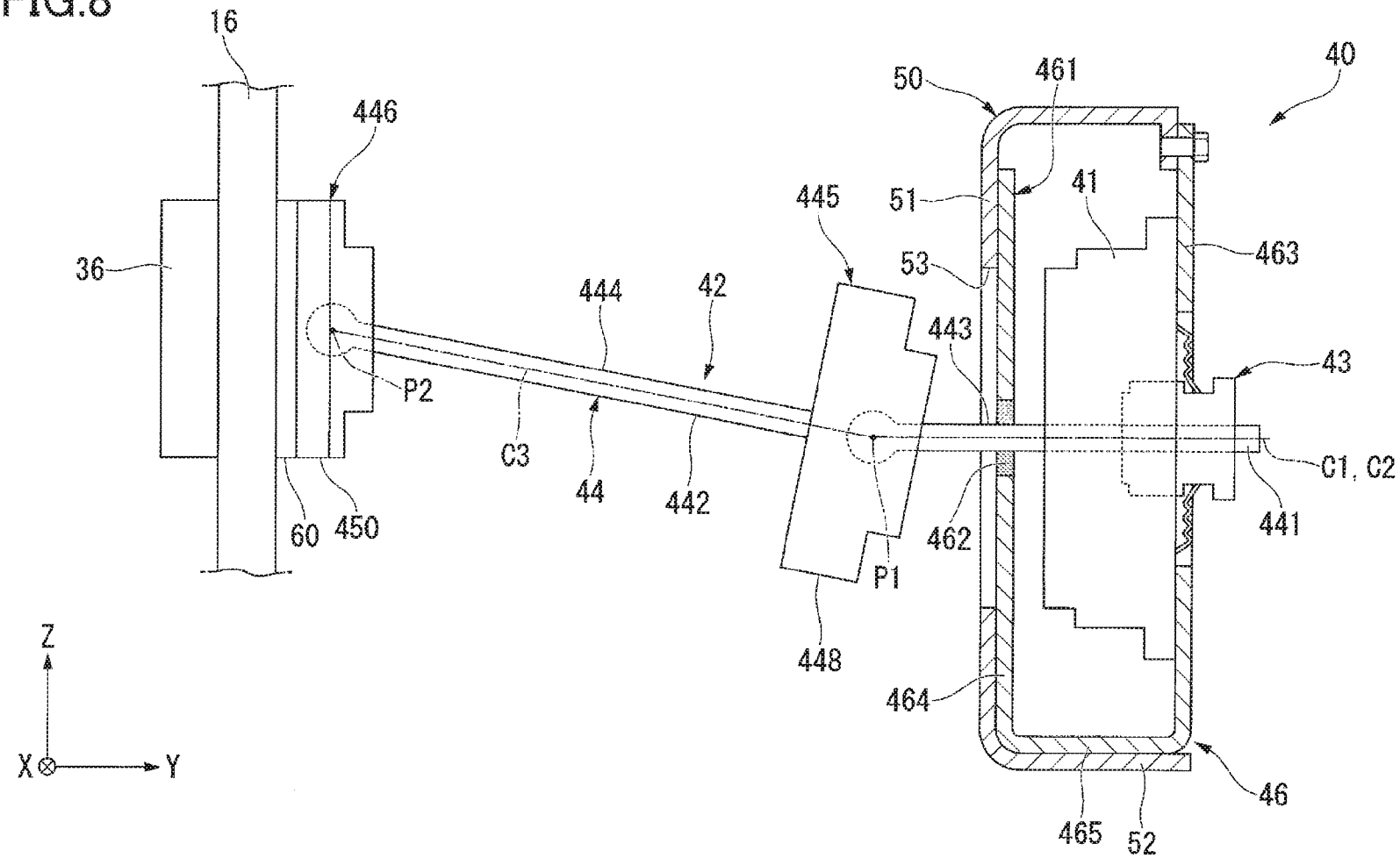
FIG. 8 is a view showing a state in which the installation structure for the acoustic transducer shown in FIG. 3 has suffered from deterioration over years.

In an instance where the piano 1 on which the acoustic transducer 40 is installed undergoes displacement of the soundboard 16 in a direction perpendicular to the predetermined direction due to deterioration over years, for instance, specifically, in an instance where the soundboard 16 undergoes displacement in the Z-axis direction as shown in FIG. 8, the intervening member 60 and the retainer portion 450 of the distal joint portion 446 which are fixed to the soundboard 16 are also displaced in the Z-axis direction with respect to the magnetic-path forming portion 41.

In the present embodiment, the connecting unit 44 includes the intermediate joint portion 445 and the distal joint portion 446. When the intervening member 60 and the retainer portion 450 of the distal joint portion 446 are displaced in the Z-axis direction, the axis C3 of the vibrated-side shaft portion 444 is inclined by the intermediate joint portion 445 and the distal joint portion 446 with respect to both of the predetermined direction and the axis C2 of the magnetic-path forming portion 41. It is consequently possible to prevent the axis C2 of the vibrating portion 42 from being inclined with respect to the predetermined direction. That is, it is possible to prevent the axis C2 of the vibrating portion 42 from being inclined with respect to the axis C1 of the magnetic-path forming portion 41 that is parallel to the predetermined direction.

According to the present installation structure for the acoustic transducer 40 and the piano 1 equipped with the same, the magnetic-path forming portion 41 is disposed such that the vibrating portion main body 43 protrudes from the magnetic-path forming portion 41 in a direction away from the soundboard 16. In other words, the acoustic transducer 40 is disposed with respect to the soundboard 16 such that its orientation is inverted or reversed with respect to an orientation in which acoustic transducers are conventionally disposed. In the thus oriented acoustic transducer 40, the vibrating portion main body 43 and the soundboard 16 are connected by the connecting unit 44 that passes through the insertion hole 410 of the magnetic-path forming portion 41. In the present installation structure, it is possible to increase a distance between a position at which the vibrating portion 42 is attached to the magnetic-path forming portion 41 and a position at which the vibrating portion 42 is connected to the soundboard 16, as compared with a conventional arrangement. Thus, even when the soundboard 16 undergoes displacement in the perpendicular direction (the X-axis direction, the Z-axis direction) due to deterioration over years, it is possible to reduce a displacement amount of the vibrating portion main body 43 with respect to the magnetic-path forming portion 41.

Hereinafter, the advantages described above will be concretely explained in terms of the structure according to the present embodiment.

When the soundboard 16 undergoes displacement in the Z-axis direction, the intermediate joint portion 445 of the connecting unit 44 may also be displaced in the Z-axis direction though a displacement amount of the intermediate joint portion 445 is smaller than that of the soundboard 16 in the Z-axis direction. Consequently, the axis C2 of the vibrating-side shaft portion 443 and the vibrating portion 42 may be inclined with respect to the axis C1 of the magnetic-path forming portion 41.

In the installation structure of the present embodiment, the acoustic transducer 40 is disposed with respect to the soundboard 16 such that its orientation is inverted or reversed with respect to the conventional orientation. It is thus possible to increase a length of the vibrating-side shaft portion 443 extending from the vibrating portion main body 43 to the intermediate joint portion 445, as compared with the conventional arrangement. Consequently, an inclination angle (displacement amount) of the axis C2 of the vibrating portion 42 with respect to the axis C1 of the magnetic-path forming portion 41 can be made smaller, as compared with the conventional arrangement.

According to the installation structure of the present embodiment, one end of the vibrating-side shaft portion 443, which corresponds to the first protruding portion 441 of the connecting unit 44, is supported by the damper portion 45 together with the vibrating portion main body 43, and another end of the vibrating-side shaft portion 443, which corresponds to the second protruding portion 442 of the connecting unit 44, is supported by the restrictor 46. In other words, the vibrating-side shaft portion 443 of the connecting unit 44 is supported at mutually different two locations on its axis. Consequently, even if a distance between the magnetic-path forming portion 41 and the soundboard 16 is small, it is possible to increase a distance between a portion of the vibrating-side shaft portion 443 at which the vibrating-side shaft portion 443 is supported by the damper portion 45 and a portion of the vibrating-side shaft portion 443 at which the vibrating-side shaft portion 443 is supported by the restrictor 46.

Consequently, even when the soundboard 16 undergoes displacement in the Z-axis direction and an external force to incline the axis C2 of the vibrating-side shaft portion 443 with respect to the axis C1 of the magnetic-path forming portion 41 acts on the vibrating-side shaft portion 443, the damper portion 45 and the restrictor 46 prevent the vibrating-side shaft portion 443 from being inclined. Thus, it is possible to further reduce the displacement amount of the vibrating portion main body 43 with respect to the magnetic-path forming portion 41.

According to the installation structure of the present embodiment, the connecting unit 44 includes the intermediate joint portion 445 and the distal joint portion 446. When the soundboard 16 undergoes displacement in the Z-axis direction, the vibrated-side shaft portion 444 inclines with respect to both of the predetermined direction and the axis C2 of the vibrating-side shaft portion 443. As a result, it is possible to prevent the axis C2 of the vibrating portion 42 from being inclined with respect to the axis C1 of the magnetic-path forming portion 41. Consequently, it is possible to further reduce the displacement amount of the vibrating portion main body 43 with respect to the magnetic-path forming portion 41.

The reduction in the displacement amount of the vibrating portion main body 43 with respect to the magnetic-path forming portion 41 causes a reduction in position deviation of the voice coil 432 of the vibrating portion main body 43 with respect to the magnetic space 417 of the magnetic-path forming portion 41. It is consequently possible to prevent noise from being mixed in sounds based on the vibration of the soundboard 16 which is vibrated by the acoustic transducer 40.

According to the installation structure of the present embodiment, the vibrating portion main body 43 is removably fixed to the first protruding portion 441 of the connecting unit 44. In other words, a position at which the vibrating portion main body 43 and the connecting unit 44 are fixed is not located between the magnetic-path forming portion 41 and the soundboard 16, whereby the magnetic-path forming portion 41 and the vibrating portion main body 43 can be easily attached to and removed from the connecting unit 44. Thus, installation of the acoustic transducer 40 on the piano 1 and maintenance of the acoustic transducer 40 can be easily performed.

According to the installation structure and the installation method of the present embodiment, the intervening member 60 is disposed between the vibrating portion 42 of the acoustic transducer 40 and the soundboard 16, and the intervening member 60 is attachable to and detachable from the vibrating portion 42, so that it is possible to fix only the intervening member 60 to the soundboard 16. Further, the intervening member 60 is easily formed so as to have a small size and weight, as compared with the acoustic transducer 40. Consequently, the intervening member 60 can be pressed onto the soundboard 16 with high stability when the intervening member 60 is fixed to the soundboard 16 by bonding. It is thus possible to fix the intervening member 60 to the soundboard 16 while the intervening member is held in close contact with the soundboard 16. In this arrangement, the vibration of the vibrating portion 42 can be suitably transmitted to the soundboard 16, so that sounds generated from the soundboard 16 that is vibrated by the acoustic transducer 40 can be suitably obtained.

Further, the vibrating portion 42 of the acoustic transducer 40 is detachably fixed to the intervening member 60, whereby the entirety of the acoustic transducer 40 including the connecting unit 44 can be easily removed from the soundboard 16. It is possible to easily perform a maintenance checkup of the acoustic transducer 40.

According to the installation structure of the present embodiment, when the vibrating portion 42 is attached to the intervening member 60 fixed to the soundboard 16, the vibrating portion 42 is easily positioned relative to the intervening member 60 by inserting the positioning protrusion 63B formed at the retainer portion 450 of the distal joint portion 446 of the vibrating portion 42 into the positioning recess 63A formed in the intervening member 60. That is, the vibrating portion 42 can be easily attached to the intervening member 60.

According to the installation structure of the present embodiment, the non-bonding region 62*b*, which is provided on the second facing surface 62 of the intervening member 60 that faces the soundboard 16, is located at a height level lower than the bonding region 62*a*. In this arrangement, even if the adhesive between the intervening member 60 and the soundboard 16 leaks from the bonding region 62*a* toward the non-bonding region 62*b* when the intervening member 60 is pressed onto the soundboard 16 for bonding and fixing the intervening member 60 to the soundboard 16, the adhesive is prevented from entering the positioning recess 63A, the internally threaded holes 65, and the screw insertion holes 67 which are open in the non-bonding region 62*b*. It is consequently possible to prevent the adhesive from causing any trouble when the intervening member 60 is fastened and fixed to the soundboard 16 by the screws 66 and when the vibrating portion 42 is fastened and fixed to the intervening member 60 by the screws 64.

While the embodiment of the present invention has been explained in detail, it is to be understood that the present invention is not limited to the details of the illustrated embodiment, but may be embodied with various changes without departing from the scope of the invention.

In the illustrated embodiment, the positioning recess 63A is formed in the intervening member 60 while the positioning protrusion 63B is provided at the retainer portion 450 of the distal joint portion 446. For instance, the positioning recess 63A may be formed in the retainer portion 450 while the positioning protrusion 63B may be provided at the intervening member 60.

The wetting preventive structure 62C formed on the second facing surface 62 of the intervening member 60 is not limited to the stepped structure of the illustrated embodiment in which the non-bonding region 62*b* is located at a height level lower than the bonding region 62*a*. For instance, the wetting preventive structure may be constituted by a groove formed between the bonding region 62*a* and the non-bonding region 62*b*. The groove corresponds to the wetting preventive structure 62C, and the groove defines a space S having the wetting preventive function. In this case, the bonding region 62*a* and the non-bonding region 62*b* may be located at the same height level.

Such a structure also offers advantages similar to those in the illustrated embodiment. That is, even if the adhesive between the intervening member 60 and the soundboard 16 leaks from the bonding region 62*a* toward the non-bonding region 62*b* when the intervening member 60 is pressed onto the soundboard 16 for fixing the intervening member 60 to the soundboard 16 by bonding, the adhesive flows in the space S in the groove. It is consequently possible to prevent the adhesive from entering the positioning recess 63A, the internally threaded holes 65, and the screw insertion holes 67 which are open in the non-bonding region 62*b*.

The intermediate joint portion 445 and the distal joint portion 446 of the connecting unit 44 may have any structure other than the ball joint structure of the illustrated embodiment. For instance, the intermediate joint portion 445 and the distal joint portion 446 may have a universal joint structure.

It is not necessarily required for the connecting unit 44 to have the intermediate joint portion 445. The connecting unit 44 may be fixed to the soundboard 16 such that the axis C2 of the connecting unit 44 is kept parallel to the predetermined direction, without including the intermediate joint portion 445 and the distal joint portion 446.

The magnetic-path forming portion 41 is not necessarily required to be disposed as in the illustrated embodiment such that the vibrating portion main body 43 is disposed so as to protrude from the magnetic-path forming portion 41 in a direction away from the soundboard 16. For instance, the vibrating portion main body 43 may be disposed so as to protrude from the magnetic-path forming portion 41 in a direction toward the soundboard 16. In this instance, the vibrating portion 42 may include only the vibrating portion main body 43 without including the connecting unit 44, and the vibrating portion main body 43 may be detachably fixed to the intervening member 60.

The acoustic transducer 40 need not be necessarily disposed within the housing 11, but may be disposed so as to be exposed to an exterior of the housing 11, for instance. That is, the acoustic transducer 40 need not be necessarily connected to the inner surface 16*a* of the soundboard 16 as in the illustrated embodiment, but may be connected to the outer surface 16*b* of the soundboard 16 that faces toward the exterior of the housing 11. In this case, the position at which the acoustic transducer 40 is connected to the soundboard 16 may be determined to be a position at which the soundboard 16 is sandwiched between the acoustic transducer 40 and the bridge 35 without interfering with the soundboard ribs 36.

In the illustrated embodiment, the soundboard 16 is illustrated as one example of the vibrated body which is to be vibrated and on which the acoustic transducer 40 is installed. The vibrated body may be other members of the housing 11 that may undergo displacement due to deterioration over years, such as the rear roof 24 and the side boards 23.

The installation structure for the acoustic transducer 40 according to the present invention is applicable to a structure in which the vibrated body does not undergo displacement and the member of the housing 11 to which the magnetic-path forming portion 41 is fixed may undergo displacement due to deterioration over years.

The installation structure for the acoustic transducer 40 according to the present invention is applicable to musical instruments having the vibrated body such as the soundboard 16. For instance, the installation structure for the acoustic transducer 40 is applicable to various musical instruments including other keyboard musical instruments such as grand pianos, stringed musical instruments such as acoustic guitars and violins, and percussion instruments such as drums and timpani.

The illustrated embodiment may be considered that the following invention is embodied: An installation structure for an acoustic transducer configured to vibrate a vibrated body in a first direction so as to permit the vibrated body to generate sounds, wherein the acoustic transducer includes: a magnetic-path forming portion that forms a magnetic path; a vibrating portion configured to vibrate in the first direction with respect to the magnetic-path forming portion; and an anchor having a bonding region on which an adhesive is applied, the anchor being provided between the vibrating portion and the vibrated body such that the anchor is undetachably fixed to the vibrated body by bonding, wherein the anchor is provided with a through-hole that penetrates therethrough in the first direction in a state in which the anchor is attached to the vibrated body, and wherein, in the state in which the anchor is attached to the vibrated body, a space is defined by the vibrated body and the anchor, and at least part of the space is located between the bonding region of the anchor and the through-hole.

EXPLANATION OF REFERENCE SIGNS

1: piano (musical instrument) 16: soundboard (vibrated body) 40: acoustic transducer 41: magnetic-path forming portion 42: vibrating portion 60: intervening member (anchor) 62: second facing surface 62*a*: bonding region 62*b*: non-bonding region 62C: wetting preventive structure 63A: positioning recess 63B: positioning protrusion

The invention claimed is:

1. An installation structure for an acoustic transducer configured to vibrate a vibrated body in a first direction so as to permit the vibrated body to generate sounds, wherein the acoustic transducer includes:

a magnetic-path forming portion that forms a magnetic path; and a vibrating portion configured to vibrate in the first direction with respect to the magnetic-path forming portion, wherein an anchor is provided between the vibrating portion and the vibrated body such that the anchor is undetachably fixed to the vibrated body by bonding and such that the anchor is detachably fixed to the vibrating portion, wherein a facing surface of the anchor that faces the vibrated body includes a bonding region bonded to the vibrated body by an adhesive and a non-bonding region not bonded to the vibrated body, and wherein a wetting preventive structure is formed on the facing surface to prevent the adhesive that leaks from the bonding region from spreading over the non-bonding region.

2. The installation structure for the acoustic transducer according to claim 1, wherein a positioning protrusion is formed at one of the vibrating portion and the anchor so as to protrude toward the other of the vibrating portion and the anchor, and wherein a positioning recess is formed in the other of the vibrating portion and the anchor such that the positioning protrusion is insertable in the positioning recess in the first direction.

3. The installation structure for the acoustic transducer according to claim 1, wherein the anchor is provided with a through-hole that penetrates therethrough in the first direction in a state in which the anchor is attached to the vibrated body, and wherein, in the state in which the anchor is attached to the vibrated body, a space is defined by the vibrated body and the anchor, and at least part of the space is located between the bonding region of the anchor and the through-hole, so that the wetting preventive structure prevents the adhesive from spreading over the non-bonding region.

4. The installation structure for the acoustic transducer according to claim 3, wherein the space is partially defined by a step formed on the facing surface of the anchor that faces the vibrated body.

5. The installation structure for the acoustic transducer according to claim 3, wherein the through-hole functions as the positioning recess.

6. The installation structure for the acoustic transducer according to claim 3, wherein the through-hole is a screw through-hole through which a screw passes for attaching the anchor to the vibrated body.

7. The installation structure for the acoustic transducer according to claim 3, wherein the through-hole is a threaded hole into which a screw is screwed for detachably fixing the vibrating portion to the anchor.

8. An installation structure for an acoustic transducer configured to vibrate a vibrated body in a first direction so as to permit the vibrated body to generate sounds, wherein the acoustic transducer includes: a magnetic-path forming portion that forms a magnetic path; a vibrating portion configured to vibrate in the first direction with respect to the magnetic-path forming portion; and an anchor having a bonding region on which an adhesive is applied, the anchor being provided between the vibrating portion and the vibrated body such that the anchor is undetachably fixed to the vibrated body by bonding, wherein the anchor is provided with a through-hole that penetrates therethrough in the first direction in a state in which the anchor is attached to the vibrated body, and wherein, in the state in which the anchor is attached to the vibrated body, a space is defined by the vibrated body and the anchor, and at least part of the space is located between the bonding region of the anchor and the through-hole.

9. The installation structure for the acoustic transducer according to claim 8, wherein a positioning protrusion is formed at one of the vibrating portion and the anchor so as to protrude toward the other of the vibrating portion and the anchor, and wherein a positioning recess is formed in the other of the vibrating portion and the anchor such that the positioning protrusion is insertable in the positioning recess in the first direction.

10. The installation structure for the acoustic transducer according to claim 8, wherein the space is partially defined by a step formed on the facing surface of the anchor that faces the vibrated body.

11. The installation structure for the acoustic transducer according to claim 9, wherein the through-hole functions as the positioning recess.

12. The installation structure for the acoustic transducer according to claim 8, wherein the through-hole is a screw through-hole through which a screw passes for attaching the anchor to the vibrated body.

13. The installation structure for the acoustic transducer according to claim 8, wherein the through-hole is a threaded hole into which a screw is screwed for detachably fixing the vibrating portion to the anchor.

14. A method of installing, on a vibrated body, an acoustic transducer including a magnetic-path forming portion that forms a magnetic path and a vibrating portion configured to vibrate in a first direction with respect to the magnetic-path forming portion, the acoustic transducer being configured to vibrate the vibrated body in the first direction so as to permit the vibrated body to generate sounds, the method comprising:

an anchor fixing step of undetachably fixing the anchor to the vibrated body by bonding;

a vibrating-portion fixing step of detachably fixing the vibrating portion to the anchor such that the anchor, which has been fixed to the vibrated body in the anchor fixing step, is sandwiched between the vibrating portion and the vibrated body, and a wetting preventive structure forming step of forming, on a facing surface of the anchor facing the vibrated body and including a bonding region bonded to the vibrated body by an adhesive and a non-bonding region not bonded to the vibrated body, a wetting preventive structure to prevent the adhesive that leaks from the bonding region from spreading over the non-bonding region.

* * * * *